US005572756A

United States Patent [19]

Muuranen et al.

[11] Patent Number: 5,572,756

[45] Date of Patent: Nov. 12, 1996

[54] AMBULANCE STRETCHERS FOR CARRYING PATIENTS

[76] Inventors: Martti Muuranen, Hatanpäänkatu 1 B, Fin-33100 Tampere; Eero Vuorenoja, Vammala, Fin-38270 Sammaljoki, both of Finland

[21] Appl. No.: 436,232

[22] PCT Filed: Nov. 22, 1993

[86] PCT No.: PCT/FI93/00494

§ 371 Date: May 17, 1995

§ 102(e) Date: May 17, 1995

[87] PCT Pub. No.: WO94/12137

PCT Pub. Date: Jun. 9, 1994

[30] Foreign Application Priority Data

Nov. 20, 1992 [FI] Finland ..... 920695 U

[51] Int. Cl.[6] ..... A61G 1/02; A61G 1/017

[52] U.S. Cl. ..... 5/626; 5/625; 296/20

[58] Field of Search ..... 5/626, 625, 620, 5/618, 613, 627, 628; 296/20

[56] References Cited

U.S. PATENT DOCUMENTS

| | | | |
|---|---|---|---|
| 2,203,045 | 6/1940 | Buntin | 296/20 |
| 2,348,210 | 5/1944 | Friedlander | 296/20 |
| 2,400,155 | 5/1946 | Letschert et al. | 5/626 |
| 3,289,219 | 12/1966 | Ferneau et al. | 5/626 |

FOREIGN PATENT DOCUMENTS

| | | | |
|---|---|---|---|
| 3410599 | 9/1985 | Germany | 5/620 |
| 3527693 | 2/1987 | Germany | 5/626 |
| 424141 | 7/1982 | Sweden | 5/625 |
| 548084 | 9/1942 | United Kingdom . | |

*Primary Examiner*—Alexander Grosz
*Attorney, Agent, or Firm*—Larson and Taylor

[57] ABSTRACT

An ambulance stretcher for transportation of patients, which has two longitudinal frame beams (2) with connecting cross-brackets (18), all of which together form a supporting frame. On top of the supporting frame a patient bed (4–7) is arranged, which is equipped with several transverse articulated or folding points (8–10) for adjustment of the patient bed into any wanted position in its longitudinal direction. Under the patient bed part (6), which is firmly fixed to the supporting frame, a rigid auxiliary frame (18*a*, 32, 34) is formed to join the frame beams (2). The auxiliary frame part has articulated points (35) for fixing adjustable patient bed parts (5, 7) and articulated points (33) for fixing supporting rods (11, 36) of the adjustable patient bed parts. The frame beams (2) are rigid through the region of the auxiliary frame and extending to at least one end of the stretcher.

6 Claims, 3 Drawing Sheets

1
17
12
14
13
31
7
18
10
3b
6
5
9
18
8
18
11
14
15
4
22
23
α
20
19
3a
30
16

AMBULANCE STRETCHERS FOR CARRYING PATIENTS

BACKGROUND OF THE INVENTION

The invention relates to an ambulance stretcher for transportation of patients.

A conventional ambulance stretcher usually has two longitudinal frame beams with connecting cross-brackets, which form a supporting frame with bearing wheels in order to facilitate placing the stretcher onto the underframe in the ambulance. Such an underframe in an ambulance can usually be pulled outwardly from the inside of the ambulance. Further, these known stretchers have telescopically adjustable handles at each end of both frame beams. In addition, a chair is usually provided in the ambulance to enable carrying a patient in narrow places. On leaving the ambulance to fetch a patient who is to be transported, one does not always know beforehand whether the patient has to be transported in prone or in sitting position. Furthermore, sometimes the lack of space can make the use of a conventional normal ambulance stretcher very complicated or even impossible. This often leads to situations where, for instance, one leaves the ambulance with a carrying stretcher and establishes on reaching the patient that the situation calls for a carrying chair, which means an extra visit to the ambulance. Therefore, an aim of the invention is to produce an ambulance stretcher for transportation of patients which makes it possible to readily convert the stretcher into, a carrying chair, whereby the extra visit to the ambulance is avoided.

BRIEF DESCRIPTION OF DRAWINGS

In the following, the invention is presented with reference to the enclosed drawings, wherein.

DESCRIPTION OF PREFERRED EMBODIMENTS

Figure 1:
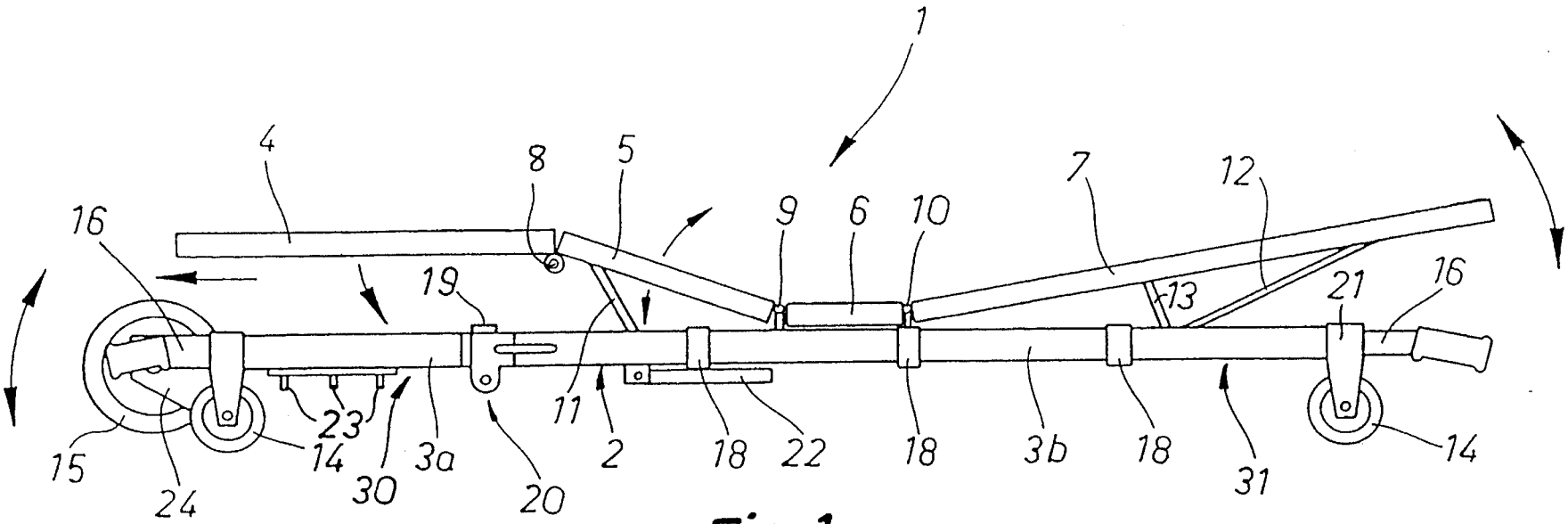
FIG. 1 is a diagrammatic side view of a stretcher, as per the invention, in normal stretcher position.
Figure 2:
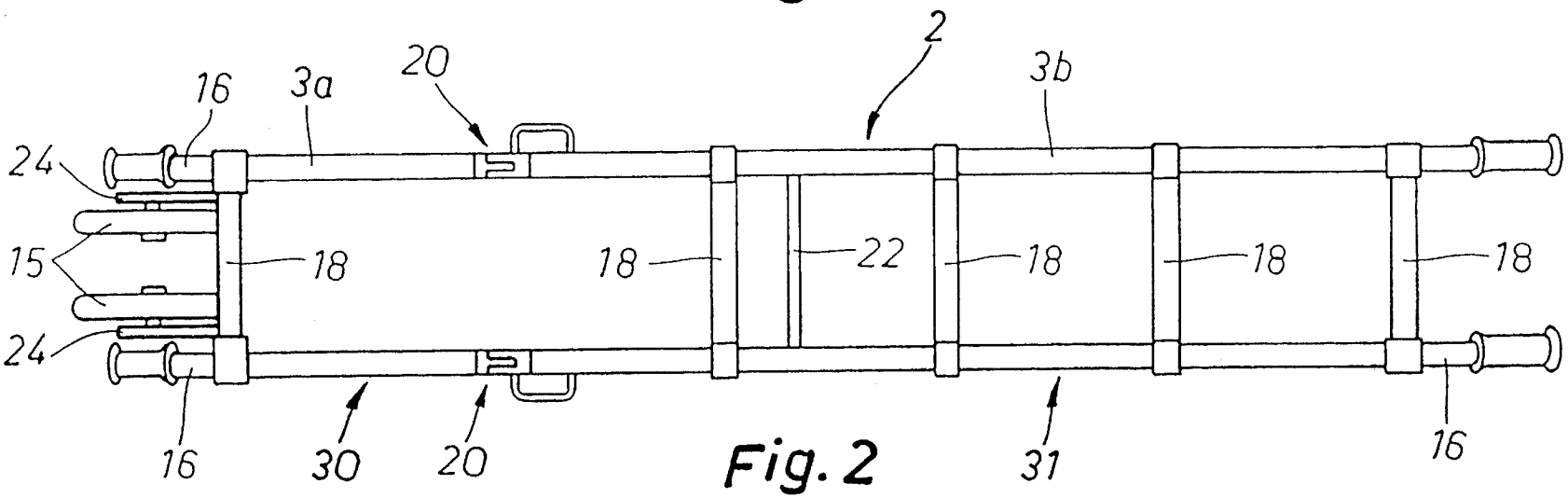
FIG. 2 is a diagrammatic top view of a stretcher, as per FIG. 1, where the patient bed is taken off.
Figure 3:
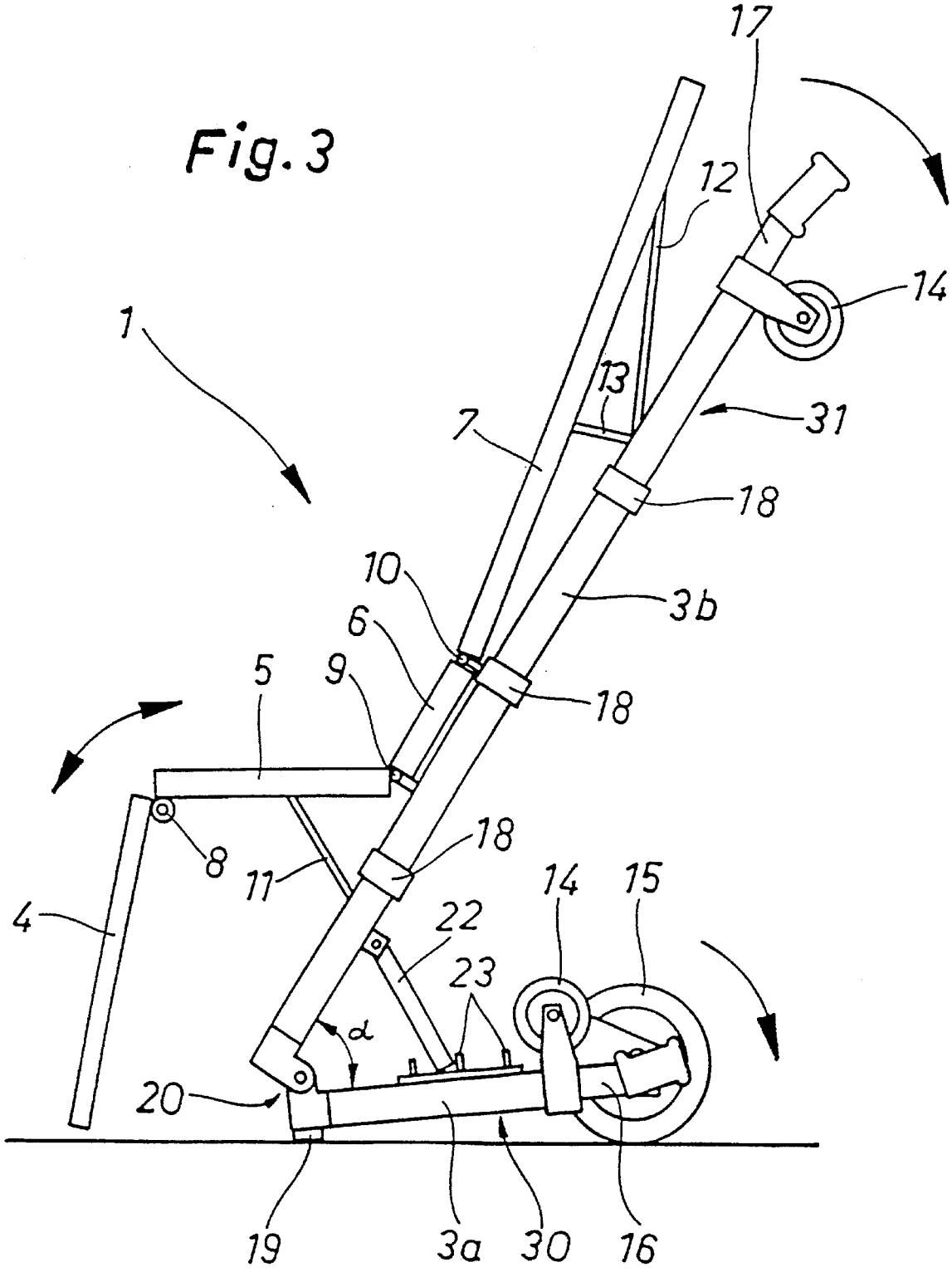
FIG. 3 is a diagrammatic side view of a stretcher, as per the invention, turned into a carrying chair position.

According to FIGS. 1–3, the stretcher has two longitudinal frame beams 2 with an articulated part 20 that divides the frame beams into two parts 3*a* and 3*b*. The parts 3*a* and 3*b* of the frame beams are rigid and so dimensioned that the frame beam part 3*b* at the patient head end is substantially longer than the frame beam part 3*a* at the patient foot end. The ratio of the length 3*b*:3*a* is, advantageously about 6:1 to 3:1, and suitably about 4.5:1. The frame beams 2 are joined together with cross-brackets 18, which form together with the frame beams 2 a supporting frame. On top of the supporting frame a patient bed is arranged, which is formed of several parts 4, 5, 6, 7 that are furnished with articulated parts 8, 9, 10 enabling adjustment of the patient bed into a wanted position. In addition, the patient bed is fitted with supporting means 11, 12, 13 in the supporting frame and which, in the illustrated embodiment, are joined to parts 5 and 7 of the patient bed. There can, of course, be a greater number of such supporting means, their construction being such as to allow turning the different parts of the patient bed into wanted angular positions. For instance, the patient head end 7 of the patient bed is advantageously furnished, on both sides, with a supporting rod (not shown), which is at one end articulated close to the top end lower edge (the outmost top end edge) and at its other end articulated in the frame beam part 3*b*. In addition, this support rod is advantageously furnished with handles at the head end in order to facilitate carrying the stretcher in sitting position. The articulated point 20 in part 3*b* of the frame beam is advantageously furnished with locking means, by means of which the stretcher is made more rigid in its sitting position. At both ends of frame beam 2 there are bearing wheels 14, which are mostly used to facilitate the placing of the stretcher into the ambulance. Usually, the ambulance is furnished with a stretcher underframe with locking means which, due to interlocking with the axle journals of the bearing wheels, anchor the stretcher to the underframe during transportation. At both ends of the frame beam 2 there are telescopically adjustable handles 16. Articulated part 20 divides the supporting frame into a supporting part 30 at the patient foot end and a frame part 31 at the patient head end. The supporting part 30 at the patient foot end can be folded backwardly under frame part 31 and can be locked into a wanted angular position $\alpha$ with respect to frame part 31.

Further, the supporting part 30 at the patient foot end is equipped with transport wheels 15 fastened, for instance, by means of a supporting plate 24 to the frame beam part 3*a*. The transport wheels 15 have a substantially bigger diameter than that of the bearing wheels 14 at both frame beam ends. The transport wheels 15 enable pushing a sitting patient with the stretcher folded into sitting position or pushing the stretcher in the position of a carrying stretcher.

Furthermore, the stretcher according to this invention is furnished with adjusting and/or locking means 22, 23 in order to adjust and lock the stretcher into a wanted angular position. In the illustrated embodiment, a U-shaped adjustment/locking member 22 is articulated to the head end part 3*b* of both frame beams and extends between both frame beams. In sitting position, the lower edge of member 22 hits against stopper 23 in the foot end part 3*b* of both frame beams. In the illustrated embodiment there are three such stoppers. In the illustrated embodiment, when the stretcher is folded into sitting position, portion 4 of the patient bed rests against the ground when the stretcher is parked. In addition, in the articulated 20 area of the foot end part 3*b* of the frame beam 2 a support 19 is arranged that contacts the ground when the stretcher is parked and folded into sitting position.

Further, the stretcher has locking means in order to lock the supporting foot end part 30 of the supporting frame and the head end part 31 of the supporting frame into an angular position at 180°, where the frame beam parts 3*a* and 3*b* form an essentially straight supporting frame.

Figure 4:
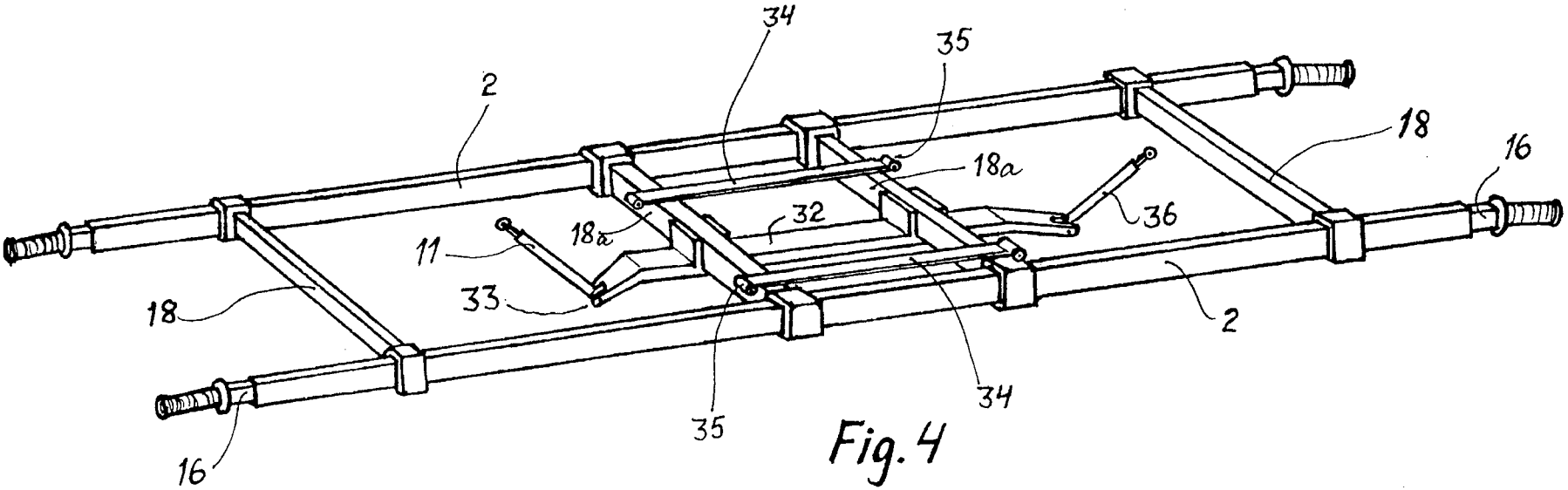
FIG. 4 is a diagrammatic perspective view of a modified construction of a supporting frame of a stretcher in accordance with the invention.

FIG. 4 shows a stretcher frame construction, where beams 2 are rigid throughout. The beams are joined together with supporting parts 18. Two adjacent supporting part 18*a* in the middle section of the stretcher are connected with two supporting rods 34, at the outer ends of which there are hinges 35 to allow articulated fixing of patient bed parts 5 and 7 to them. Further, an auxiliary frame 32 is connected to supporting parts 18*a*. At the top end of auxiliary frame 32, points of attachment are arranged for supporting rods 11 and 36, by means of which the patient bed parts 5 and 7 are supported at different desired angles with respect to the stretcher frame. Part 6 of the patient bed is firmly fixed onto supporting rods 34. All forces from the patient are directed to this part between supporting parts 18*a*, which is made rigid by auxiliary frame 32 and supporting rods 34. Only this part of the frame must be made rigid, among others rigid against torsion, so it will retain its shape when loaded and inclined. Other parts of the frame can be dimensioned for smaller forces. The frame illustrated in FIG. 4 is applicable also to the constructions as per FIGS. 1–3.

The stretcher frame may be fabricated of glass fiber or other material which is a non-conductor of electricity.

What is claimed is:

1. An ambulance stretcher for transportation of patients comprising two longitudinal frame beams with connecting cross-brackets, all of which together form a supporting frame, the frame having handles at each end of each beam; an adjustable patient bed mounted on top of the supporting frame, said patient bed having articulated or folding points for adjustment of the patient bed into a wanted position in its longitudinal direction;

a rigid frame rigidly fixed to said supporting frame, said rigid frame being located below and rigidly supporting a middle portion of the patient bed in the middle portion of the stretcher, said rigid frame having first articulated points for fixing said articulated or folding portions of the adjustable patient bed and further articulated points for fixing members supporting said articulated or folding portions of said patient bed, said frame beams extending rigidly through the region of said rigid frame to at least one end of the stretcher.

2. An ambulance stretcher according to claim 1 wherein said supporting frame comprises a foot end supporting member located at a foot end of the stretcher, said foot end supporting member being foldable backwardly under the supporting frame into any wanted angular position whereby the patient bed is substantially adjustable into a chair-forming position, and wherein the foot end supporting member is furnished with bearing wheels.

3. An ambulance stretcher according to claim 2 wherein the frame is fabricated of non-electrically conducting material.

4. An ambulance stretcher according to claim 3 wherein the non-electrically conducting material comprises glass fiber.

5. An ambulance stretcher according to claim 1 wherein the frame is fabricated of non-electrically conducting material.

6. An ambulance stretcher according to claim 5 wherein the non-electrically conducting material comprises glass fiber.

* * * * *